US007770416B2

(12) United States Patent
Jürgens et al.

(10) Patent No.: US 7,770,416 B2
(45) Date of Patent: Aug. 10, 2010

(54) TOOL SET AND BAR FOR A KNITTING MACHINE

(75) Inventors: Eric Jürgens, Bisingen (DE); Andreas Dietz, Geislingen (DE); Torsten Butz, Meßstetten (DE); Klaus Kirchmair, Nusplingen (DE)

(73) Assignee: Groz-Beckert KG, Albstadt (DE)

( * ) Notice: Subject to any disclaimer, the term of this patent is extended or adjusted under 35 U.S.C. 154(b) by 25 days.

(21) Appl. No.: 12/149,585

(22) Filed: May 5, 2008

(65) Prior Publication Data

US 2008/0276653 A1 Nov. 13, 2008

(30) Foreign Application Priority Data

May 3, 2007 (EP) ..... 07008922

(51) Int. Cl.
*D04B 27/06* (2006.01)

(52) U.S. Cl. ..... 66/114

(58) Field of Classification Search ..... 66/206, 66/207, 208, 104, 123
See application file for complete search history.

(56) References Cited

U.S. PATENT DOCUMENTS 2,902,847 A * 9/1959 Kohl ..... 66/114
2,913,888 A 11/1959 Amidon
3,584,480 A * 6/1971 Zwingenberger et al. ..... 66/114
3,783,646 A * 1/1974 Naumann et al. ..... 66/120
3,823,581 A * 7/1974 Russo ..... 66/208
4,154,068 A * 5/1979 Hagel et al. ..... 66/121
4,532,781 A 8/1985 Buck
4,745,781 A * 5/1988 Schuelein et al. ..... 66/214
5,373,710 A * 12/1994 Roth ..... 66/114
5,954,003 A * 9/1999 Beyer et al. ..... 112/80.45

FOREIGN PATENT DOCUMENTS

DE 610511 A * 3/1935
DE 4321059 A1 1/1995
WO WO 9500690 A1 * 1/1995

OTHER PUBLICATIONS

English translation of Chinese Official Action issued on Mar. 11, 2010 in Chinese Application No. 200810092855.6.

* cited by examiner

*Primary Examiner*—Danny Worrell
(74) *Attorney, Agent, or Firm*—Fitch, Even, Tabin & Flannery; Norman N. Kunitz

(57) ABSTRACT

To simplify the setup of a bar and associated tools of a knitting machine and to improve the degree of precision regarding fineness and the level of sturdiness of the tools and bar system, the holding parts (7, 9) of the tools (4, 5) of the tool set (2) are configured differently. On the holding parts (7) of at least one tool type, means (22) are provided for positioning the tools (4) on the bar and thus means for defining the division. Separate positioning means for positioning and defining the division may be assigned to the other tools (5). Alternatively, they may be positioned by the tools (4) of the first type, between which they are accommodated. If positioning grooves are provided in the bar or parts thereof, these grooves may be set up for twice the distance of division, which results in robust and mechanically stable solutions with finer divisions.

12 Claims, 5 Drawing Sheets

TOOL SET AND BAR FOR A KNITTING MACHINE

CROSS REFERENCE TO RELATED APPLICATION

This application claims the priority of European Patent Application No. 07 008 922.2, filed on May 3, 2007, the subject matter of which, in its entirety, is incorporated herein by reference.

BACKGROUND OF THE INVENTION

The invention relates to a tool set for loading a bar of a knitting machine, as well as to a bar that is set up for the accommodation of tools, in particular the tool set in accordance with the invention.

The bar of a knitting machines holds a large number of tools such as, for example, needles, sliders or the like, that are accommodated so as to be aligned parallel to each other at pre-specified distances. When the bar is moved, all the tools perform the same movement. The tools are mounted to the bar at fixed distances from each other. Usually, the distances are pre-specified by grooves that are machined parallel to each other in the bar and accommodate the holding parts of the tools.

The measure for division is fineness. It is given by the number of tools per English inch. A fineness of E40 denotes 40 knitting tools per inch.

Extremely high degrees of fineness can be achieved only with very slim tools. The strips that limit the grooves for the accommodation of the holding parts are also very thin. With increasing fineness, this initially leads to manufacturing difficulties and high manufacturing expenses and to decreased stability or sturdiness of the tools, as well as of the bars, in particular their strips.

It is the object of the invention to remedy this and to provide a robust solution for achieving high degrees of fineness.

SUMMARY OF THE INVENTION

The above object generally is achieved with the tool set in accordance with claim 1, as well as with the bar in accordance with claim 9 and/or 10:

The tool set in accordance with the invention contains tools of at least one first type and one second type that differ from each other regarding the configuration of their holding parts. Consequently, the tool set may be divided into at least two groups of tools that are alternately arranged on the bar. The holding parts are used for affixing the tools to the bar and, in so doing, fix the position of the tools. In so doing, also the division, i.e., the distance of adjacently arranged tools from each other is defined. The concept of different configurations of the holding parts of the two different tool types, said holding parts being installed in an alternating manner, permits the arrangement of the means for positioning and for defining the division outside the immediate intermediate spaces of adjacent holding parts. As a result of this, the entire length of the bar can be utilized and filled by holding parts. The widths of the individual holding parts may be defined in that the length of the bar is divided by the total number of holding parts to be supported. Neither intermediate walls nor other means between the individual holding parts are necessary in order to achieve positioning of the tools. Positioning may take place in those sections of the holding parts, where the holding parts of the first and the second type of tools are different from each other.

This concept permits the setup of bars and tool sets that define an extremely fine division of clearly greater than E40. In so doing, the tools are relatively sturdy because their width to be measured on the holding part may be at most equal to the division. No structures having a width that would be substantially less than that of the division itself are required on the bar. This also results in a sturdy bar that can be manufactured in an efficient and precise manner.

Preferably, the tools of the first and of the second type have matching stitch-forming regions, i.e., working parts. The working parts are, for example, hooks, sliders, slider slits, knives, thread eyelets or the like.

Preferably, the working parts of the tools have a width that is smaller than the width of the holding parts. In so doing, the width is measured alongside the bar and thus transverse to the longitudinal direction of the tools, or is defined by the distance of the lateral surfaces of the tools. By tapering the working parts of the tools relative to their holding parts, a distance is then kept free between the holding parts of adjacent tools, when the holding parts are arranged side by side and, together, limit only extremely small gaps.

However, it is also possible to have the tools of one type of tools of the set of tools face in another direction than the tools of the other type. In this special case, the working parts may be at least as wide as the holding parts.

The holding parts of the tools of the at least two different types differ from each other, preferably with regard to their holding part height at least one pre-specified axial position. In so doing, the height of the holding part is measured perpendicular to the longitudinal direction of the tools. In other words: the height of the holding part is the distance between the upper and the lower narrow sides of each holding part at the given point.

The different holding part height at the given axial position of the two different types of tools permits the configuration of a first embodiment, in which, for example, only the tools of the first type are positioned on the bar via suitable positioning means. The positioning means may comprise grooves, slits or other cutouts, into which the greater height of the holding part may engage. The holding parts of the tools having the lower holding part height may then be arranged between these positioned tools and are thus automatically positioned. Consequently, the tools of the one type form, as it were, the groove walls for forming the grooves for the accommodation of the holding parts of the tools of the other type.

However, it is also possible to assign, to the holding parts of the tools of the two different types on the bar respectively their own cutouts, said cutouts being offset relative to each other in longitudinal direction of the tools. For example, the tools of the one type have a greater height on a front holding part section, whereas the holding parts of the tools of the second type have a greater height on a rear section. The bar is provided, for the holding parts of the tools of the first type, with a first row of cutouts and, for the accommodation of the holding parts of the tools of the second type, with a second row of cutouts. Then, the two rows of cutouts are offset with respect to each other, for example, by the dividing measure in longitudinal direction of the bar. For example, the cutouts may be grooves or slits. In addition, one row of cutouts is located in a front region of the bar and the other row is located in a rear region. Consequently, the two rows are also offset with respect to each other in longitudinal direction of the tools. As a result of the described measure the tools of both types are positioned independently. The tools may contact each other on their holding parts but need not do so. This makes it possible to set relatively generous production tolerances with respect to the thickness of the holding parts, whereby the tolerances have little or no influence on the positioning accuracy of the individual tools and, in any event, do not add up over the length of the bar.

Positioning of the tools in a direction perpendicular to the longitudinal direction of the bar and the longitudinal direction of the tools (vertical direction) is typically achieved by the support surface of the bar itself, said support surface being provided with the cutouts. However, it is also possible to allow the, for example, slit-shaped cutouts oriented in the longitudinal direction of the tools to be intersected in transverse direction, i.e., in longitudinal direction of the bar, by a positioning groove that is deeper than the individual tool grooves. Such a positioning groove may also be provided in a region of the bar that is not provided with cutouts or slits. This groove is disposed to accommodate positioning projections that are provided on the tools and are disposed to define the position of their height. In this case, the tools do not abut against the abutment surface, i.e., the upper side of the bar.

Axial positioning of the individual tools is preferably done by a separate foot which, to achieve this, extends into a groove of the bar provided therefor. This foot preferably has the same configuration on the holding parts of the tools of both types.

Additional details of advantageous embodiments of the invention result from the drawings, the description or the claims. The description refers to essential details of the invention and to miscellaneous details. The drawings show additional details and, to this extent, supplement the description.

DETAILED DESCRIPTION OF THE INVENTION

Figure 1:
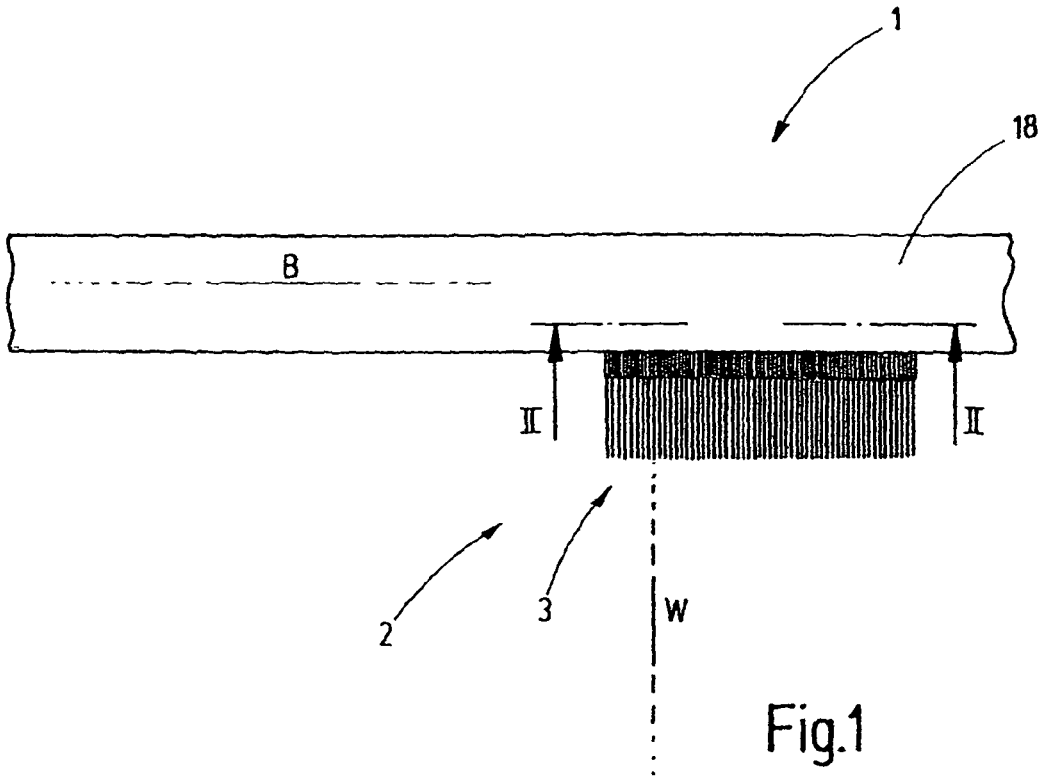
FIG. 1 is a schematic plan view of a bar of a knitting machine.
Figure 2:
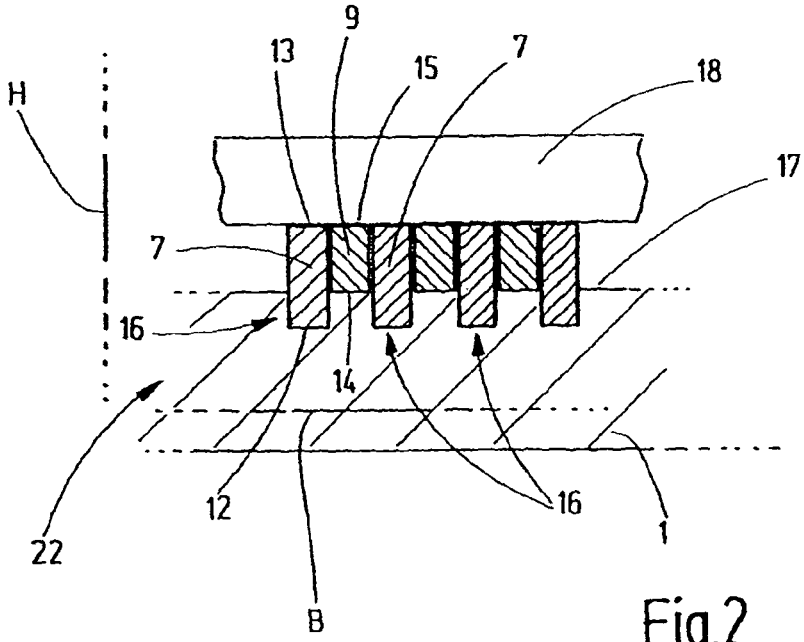
FIG. 2 is a sectional view, along line II-II in FIG. 1, of the bar in accordance with FIG. 1, shown in a different size in section and highly schematic.
Figure 3:
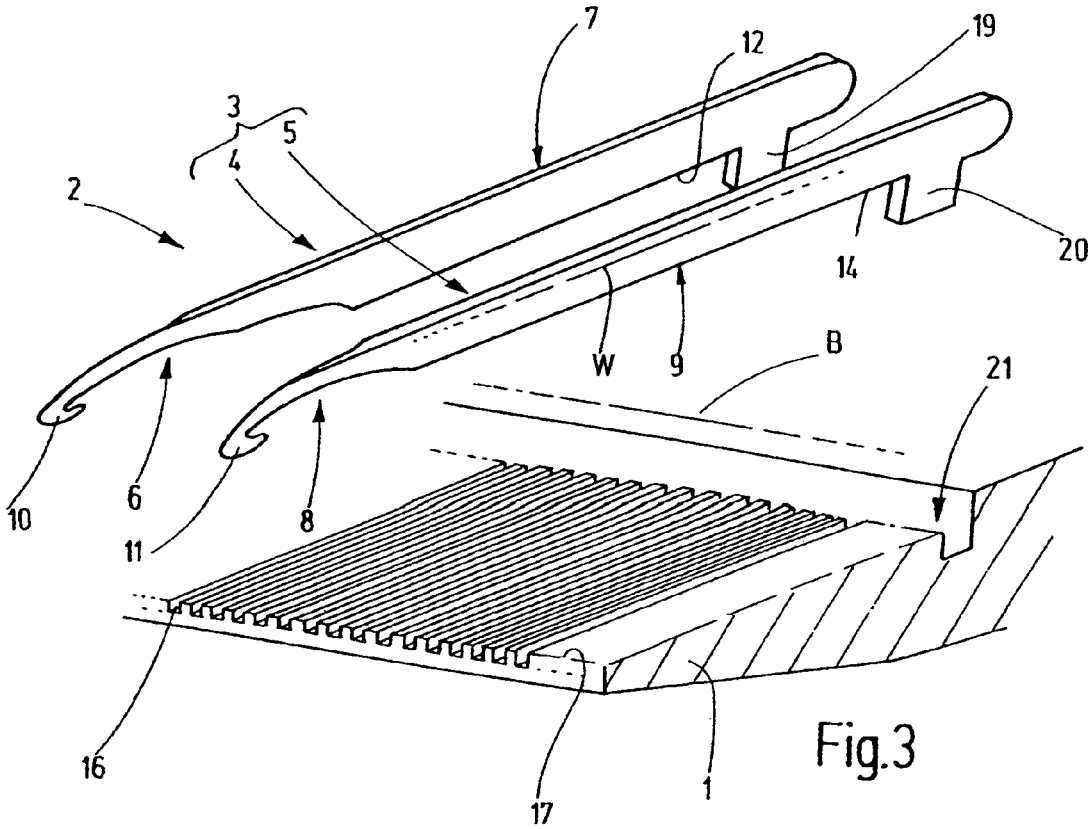
FIG. 3 is a schematic exploded view of the bar in accordance with FIG. 1 with a tool of a first type and with a tool of a second type for loading the bar.

FIG. 1 shows a bar 1 which belongs to a knitting machine. The bar holds a number of tools 2 that are arranged in a row next to each other along the longitudinal direction B of the bar. In so doing, each of the tools 2 has a longitudinal direction W that is oriented in a direction transverse to the longitudinal direction B. The tools 2 are, for example, knitting tools in the form of knitting needles, sliders, needles with holes, knives or the like. They are used for the production of knit goods in textile production. The tools 2 form a tool set 3 that comprises a number of tools 4 of a first type and a number of tools 5 of a second type, as is obvious from FIG. 3. Each of the tools of the first type 4 has a working part 6 and a holding part 7. Each of the tools 5 of the second type has a working part 8 and a holding part 9. The working parts 6, 8 preferably match. Consequently, a uniform contour is formed on the bar 1. If the working parts 6, 8, for example, have hooks 10, 11 on their ends, said hooks are on the same line. However, the tools 4, 5 differ from each other regarding the configuration of their holding parts 7, 9. They have a thickness which is to be measured between their lateral surfaces transverse to the longitudinal direction W of the tools. In so doing, the thickness is only slightly less than the center-to-center distance between adjacent tools 4, 5. The thicknesses of the two working parts 7, 9 are preferably matching. However, in the present exemplary embodiment they are different regarding their height that is to be measured in the direction H between the respective narrow sides 12, 13, 14, 15 of the holding parts 7, 9. As is obvious from FIGS. 2 and 3, the tools 4 and their holding parts 7, respectively, are associated with cutouts 16 in the form of grooves on the bar 1. These cutouts 16 intersect the upper support surface 17 of the bar 1 and are oriented in a direction transverse to the longitudinal direction B of the bar 1. Their width essentially corresponds to the width of the holding parts 7 of the tools 4 of the first type. Their depth corresponds to the height difference between the holding parts 7, 9 of the tools 4, 5. The distance between adjacent grooves and between the cutouts 16, respectively, corresponds to twice the division. The division is the center-to-center distance between adjacent tools 4, 5. While the holding parts 7 of the tools 4 are seated on the bottom of the cutout 16, the holding parts 9 of the tools 5 are seated on the support surface 17. Their upper narrow sides 13, 15 are on the same plane and are tensioned by a clamp strip 18 relative to the bar 1.

While the holding parts 7, 9 may have different heights, their length is preferably the same. Preferably, they have a foot 19, 20, in the same axial position, said foot, e.g., extending away from the lower narrow side 12 or 14. Said foot is associated with a longitudinal groove 21 in the bar, said longitudinal groove extending parallel to the longitudinal direction B and transversely to the grooves 16. It is used for axial positioning of the tools 4, 5.

The bar 1 is loaded with tools 2 of the tool set 3 in that the tools 4 of the first type are set in the grooves 16. Their holding parts 7 now form, in between each other, accommodation spaces of slits for the accommodation of the holding parts 9 of the tools 5 of the second type. Consequently, the tools 4 are positioned by the grooves 16 in longitudinal direction B in accordance with a pre-specified division, i.e., at twice the measure of division. Consequently, the sections of the holding parts 7 that extend into the cutouts or grooves 16 form, together with the cutouts 16, a positioning means 22 for the tools 4 of the first type. The tools 5 of the second type are not associated with such a positioning means. However, they find their position in that they fit—with the most minimal play—between the holding parts 7 of adjacent tools 4.

The tools 4, 5 may support each other. Between them, there remains a hardly noticeable slit, or they abut against each other along their flat sides, without being pre-tensioned. Elastic or plastic elements, or an elastically or plastically damping material, may be provided in the slit Divisions of E50 and finer can be achieved. The tools 2 remain robust. They utilize the maximum available thickness, in particular in the region of their holding parts 7, 9. The working parts 6, 8 of all the tools 4, 5 may be aligned parallel to each other. Their thickness may be slightly less than that of the holding parts 7, 9.

The presented embodiment may be modified. For example, the grooves or cutouts 16 need not inevitably have the same width as the working parts 7. Rather, it is also possible to make the grooves or cutouts 16 narrower and to also correspondingly reduce the thickness of the section of the holding part 7 provided for engagement in the cutout 16. Thus, it becomes a rib extending centrically or off-center in longitudinal direction, said rib—together with the groove—forming the required positioning means 22. It is also possible to provide, instead of the groove 16, a narrow, e.g., strip-like projection extending upward from the support surface 17, said projection having a significantly smaller width than the holding part 7 of the tool 4. This projection may engage in a longitudinal groove of the holding part 7, said groove being provided on the lower narrow side 12. Again, the projection provided on the bar 1, said projection coming into engagement with the longitudinal slit of the holding part 7, is the desired positioning means 22. It is also possible to configure this projection or rib as a thin plate or strip that is set in a groove provided in the bar for this purpose. Also, referring to this exemplary embodiment, the basic principle has again been implemented, this meaning that the positioning means comes into contact with every second holding part 7 and that the holding parts 9 located in between are positioned by the holding parts 7. Again, the basic principle is reflected by the different configuration of the holding parts 7, 9 of the two types of tools.

Figure 2A:
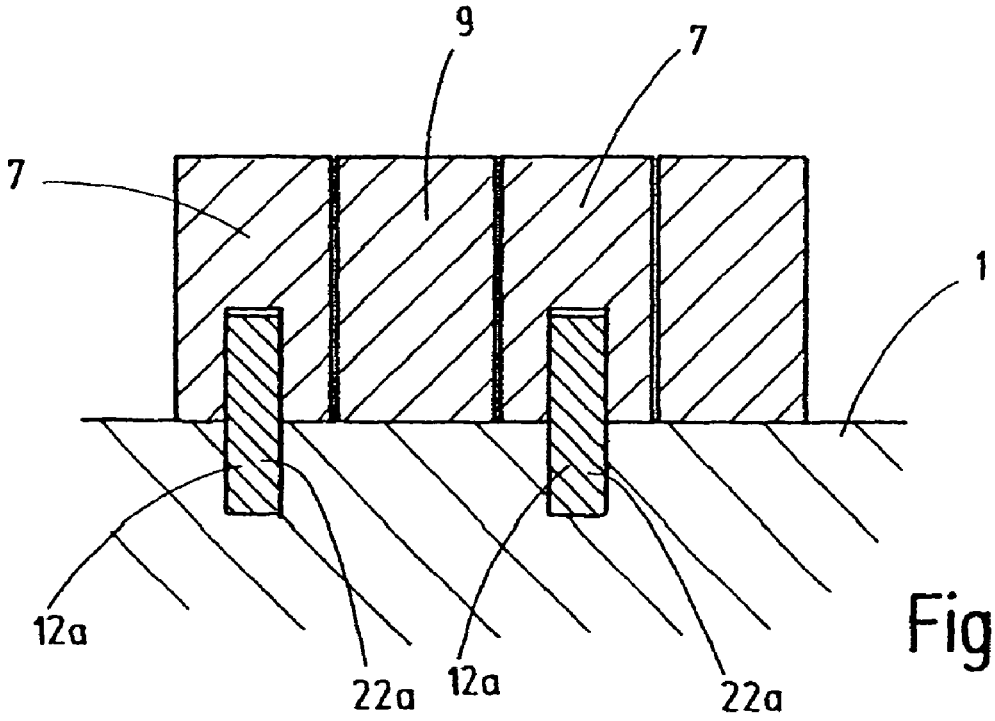
FIG. 2*a* is a sectional view, along line II-II in FIG. 1, of another embodiment, shown in another size in section and highly schematic.

A modification in accordance with FIG. 2*a* is also possible. Here, the positioning means 22 for the holding part 7 is formed by a cutout (groove) 12*a* in which the a bar or a strip 22*a* is seated. This strip comes into engagement with a cutout of the holding part 7. The holding part 9 is without cutout and is positioned by the adjacent holding parts 7. Gaps may exist between adjacent holding parts 7, 9. The strip 22*a* may be connected in one piece with the bar 1 or with the holding part 7 of the needle 4.

Figure 4:
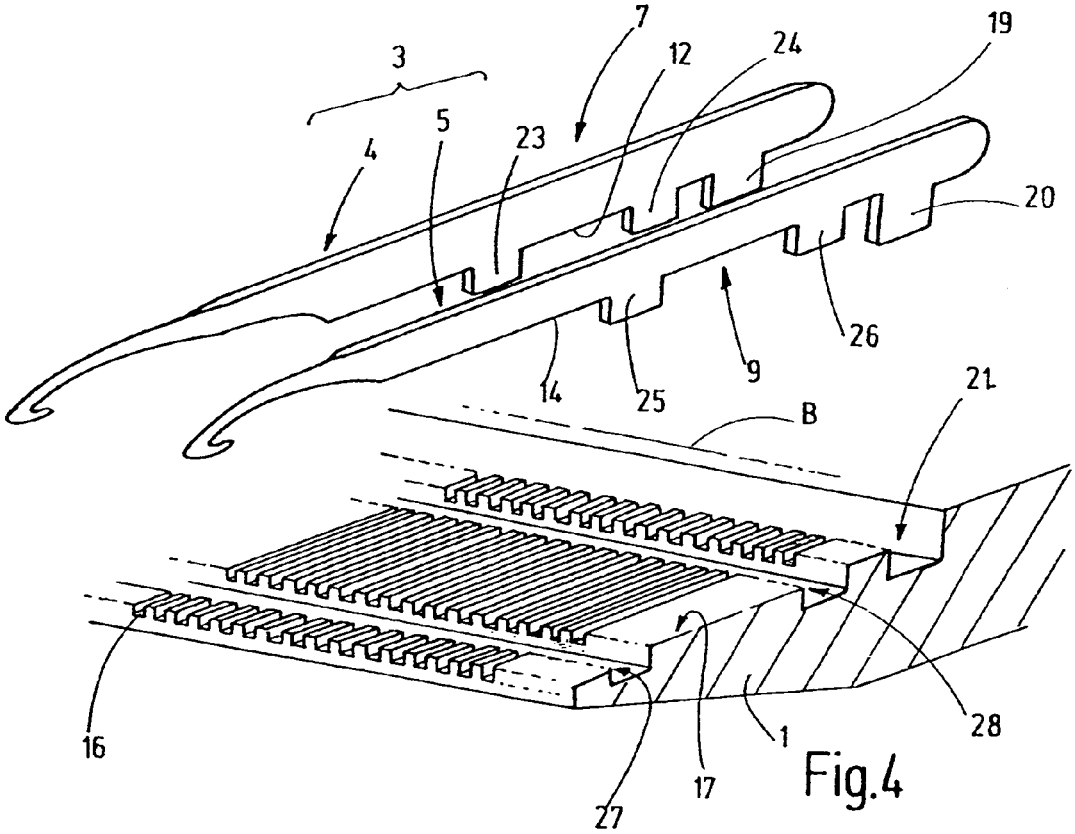
FIG. 4 is a representation in accordance with FIG. 3 of a modified embodiment of the bar and the tools.

FIG. 4 shows another embodiment of the invention. In this case the positioning of the tools 4, 5 of the tool set 3 takes place as described above. Therefore, using the same reference numbers, reference is made to the above description. However, the narrow sides 12, 14 of the tools 4, 5 in accordance with FIG. 4 do not abut against the bar 1. Rather, to achieve this, suitable projections, for example, in the form of feet 23, 24 25, 26, are provided, said feet coming into engagement with the longitudinal grooves 27, 28 of the bar 1. The longitudinal grooves 27, 28 extend parallel to the longitudinal direction B and thus in a direction transverse to the cutouts or grooves 16. The longitudinal grooves 27, 28 may intersect the cutouts 16 or extend through grooveless regions of the support surface 17.

Figure 5:
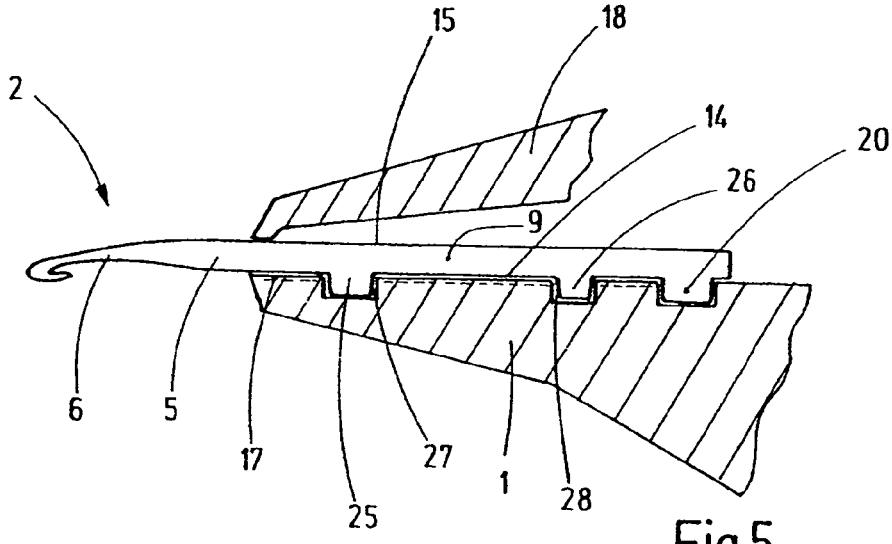
FIG. 5 is a schematic cross-sectional view of the bar in accordance with FIG. 3.

The length of the feet 23 to 26 is dimensioned in such a manner that they define the position of height of the tools 2. This is obvious, in particular, from FIG. 5. Said figure illustrates matters with reference to tool 5, the narrow side 14 of which being arranged at a minimal distance above the support surface 17. The ends of the feet 25, 26 abut against the bottoms of the longitudinal grooves 27, 28. The same applies to the tools 4 of the first type.

Figure 6:
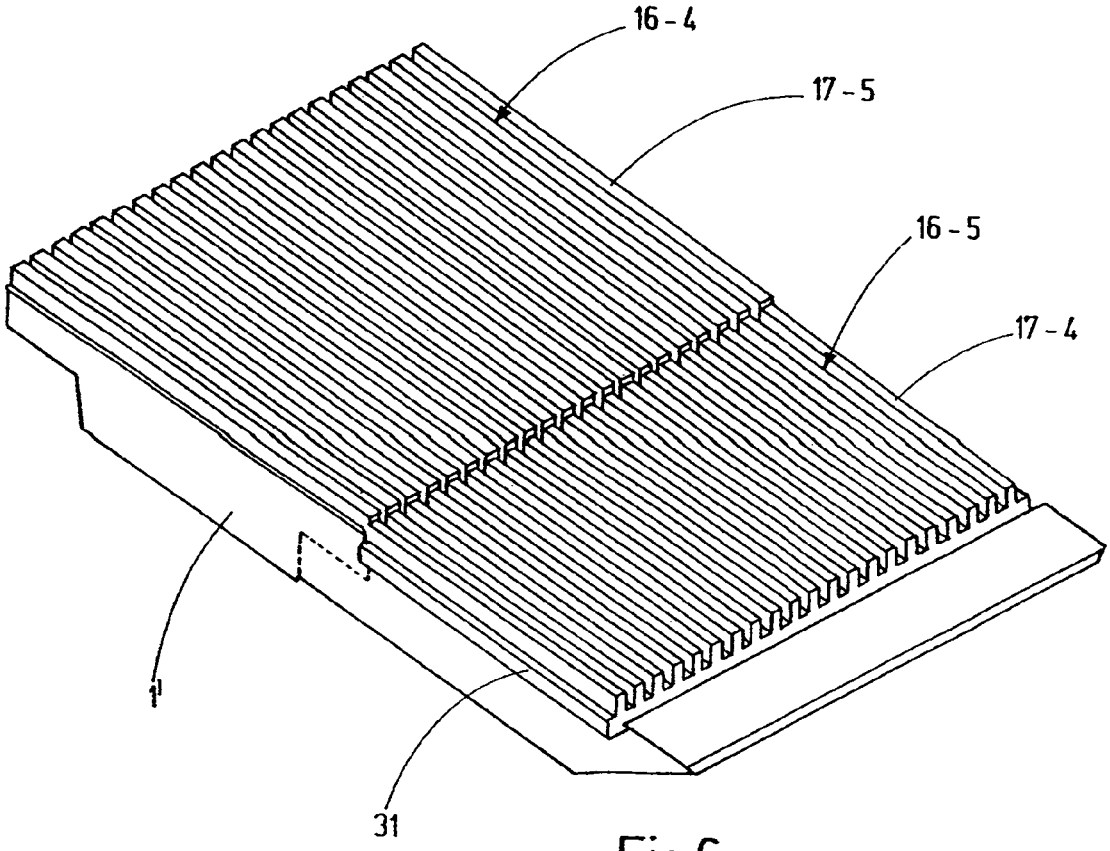
FIG. 6 is a perspective view of a modified embodiment of a bar for the accommodation of a tool set with two different types of tools.
Figures 7, 8:
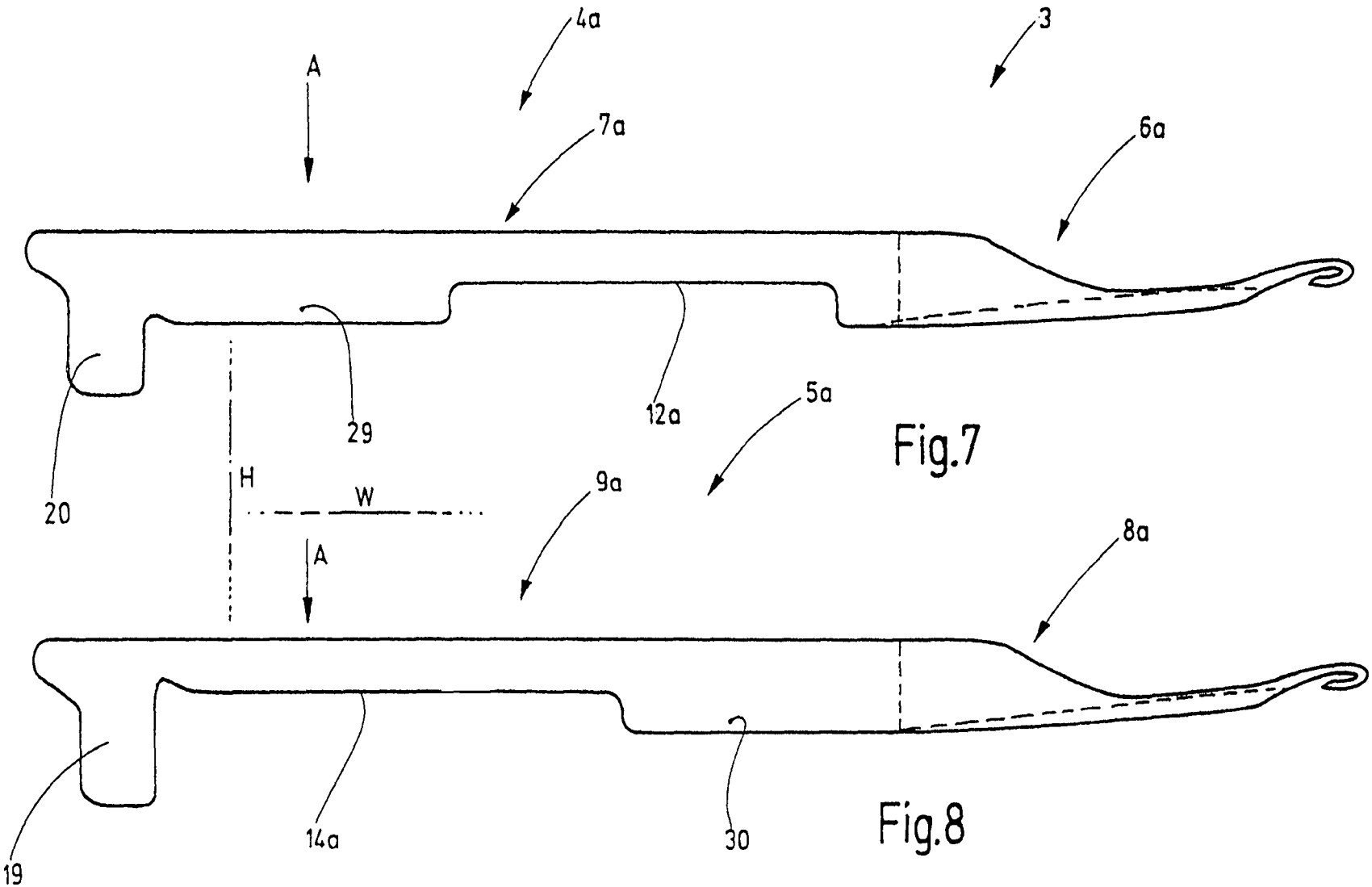
FIGS. 7 and 8 are side views of tools of different types, said tools belonging to one and the same tool set and being provided for the bar in accordance with FIG. 6.

Together, FIGS. 6 through 8, show another modified embodiment of the invention. Referring to this embodiment, the tool 4*a* of the first type shown by FIG. 7 and also the tool 5*a* of the second type are assigned positioning means. Correspondingly, the bar 1' has positioning means for both types of tools 4*a*, 5*a* of the tool set 3. On the side of the bar 1', the positioning means are represented by grooves 16-4, 16-5 or other suitable cutouts. The grooves 16-4 form a first group of positioning means which interact with the sections 29 of the holding parts 7*a* of the tools 4*a* of the first type. Strip walls are provided between the grooves 16-4, said walls' upper narrow sides forming a part of the support surface 17-5. The narrow sides 14*a* of the tools 5*a* will be seated on them.

The grooves 16-4 are at a distance from each other that is twice the distance of division. The slit walls limiting them have a thickness that essentially corresponds to the thickness of the holding part 9*a*.

The holding part 9*a* of the tool 5*a* is of low height in a section close to its foot 19, whereby said height is to be measured in the direction H perpendicular to the longitudinal direction W. At a correspondingly equal axial position close to the foot 20, the holding part 7*a* of the tool 4*a* has a comparatively greater height. The height difference between the two holding parts 7*a*, 9*a* preferably corresponds to the depth of the groove 16-4.

In a section of the holding part 7*a*, 9*a* remote from the feet 19, 20, said holding part bordering the working part 6*a*, 8*a*, the holding sections 7*a*, 9*a* also have different heights. Here, the holding part 9*a* is provided with a section 30 that is designed to engage in grooves 16-5. They are offset with respect to the grooves 16-4 by one division, i.e., by slightly more than one thickness of the holding part 7*a* and/or 9*a*. In so doing, the strip walls that divide the grooves 16-5 from each other preferably are in alignment with the grooves 16-4. The upper narrow sides of the strip walls that limit the grooves 16-5 are located on a common plane and form a support surface 17-4. This support surface 17-4 is preferably located on the same plane as the support surface 17-5. It acts as the support for the narrow sides 12*a* of the tools 4*a*.

The grooves 16-5 may be provided in or on a separated part 31 of the bar 1', said part being set in a wide, shallow longitudinal groove of the bar 1' and positioned there as desired. Other than that, the above description applies analogously. In particular, it is possible, for positioning the feet 19, 20, to provide separate cutouts (not specifically shown in FIG. 6), for example, a longitudinal groove. Furthermore, grooves corresponding to the longitudinal grooves 27, 28 and feet for supporting the tools 4*a*, 5*a*, said feet corresponding to the feet 23 through 26, may be provided in other to position the tools 4*a*, 5*a* with respect to their height. Furthermore, the combination with features of the previous embodiments is possible. For example, the grooves 16-5 may be omitted when the tools 5*a* have a continuously low strip height corresponding to the tools 5. Then they are positioned by the tools 4. Conversely, the grooves 16-4 may also be omitted, in which case the tools 4*a* are then positioned by the tools 5*a*.

Each and every technically practical combination of the features of the described embodiments is expressly taken into consideration as an embodiment of the invention, as long as said embodiment is covered by the protective scope of the claims hereinafter.

In order to simplify the setup of a bar and the associate tools of a knitting machine and in order to improve the degree of precision regarding fineness and the level of sturdiness of the system consisting of the tools and bar, it is provided that the holding parts 7, 9 of the tools 4, 5 of the tool set 2 be configured differently. This offers the opportunity to provide, on the holding parts 7 of at least one tool type, means 22 for positioning the tools 4 on the bar and thus means for defining the division. Separate positioning means for positioning and defining the division may be assigned to the other tools 5. Alternatively, they may be positioned by the tools 4 of the first type, between which they are accommodated.

Figure 2B:
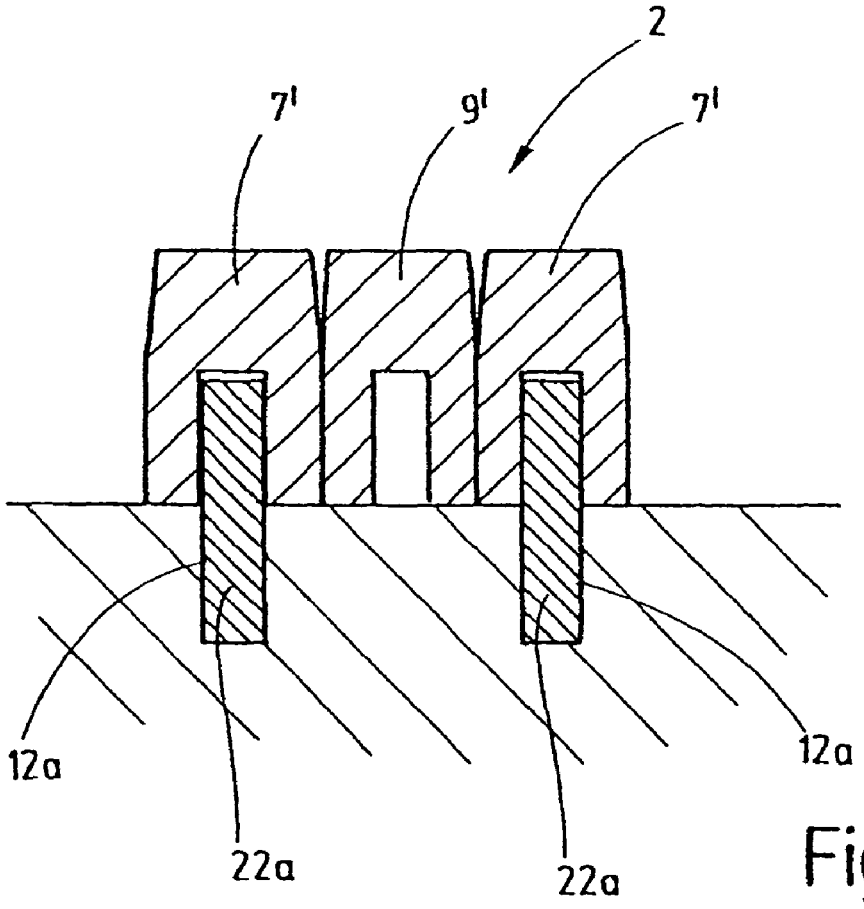
FIG. 2*b* is a sectional view, along line II-II in FIG. 1, of another embodiment, shown in another size in section and highly schematic.

FIG. 2*b* shows another modification of the invention. This embodiment is based on the embodiment in accordance with FIG. 2*a*, in which case, however, the tools 2 may be configured the same. In particular, each of the holding parts 7', 9' may be the same. The above description applies analogously—in particular regarding FIG. 2*a*—to FIG. 2*b*. Different from the above description, however, it is possible to omit the gaps between the holding parts 7', 9'. The flanks that limit the slit in each of the holding parts 7', 9' may be slightly resilient. The strips 12*a* may be slightly wedge-shaped and taper in upward direction. If the holding parts 8', 9' are pushed onto the strips 22*a*, the flanks of each holding part 7' may slightly spread away from each other and thus clamp the flanks of the holding part 9' in place. By slightly widening the holding parts 7' in transverse direction (i.e., bar's longitudinal direction B) and by slightly compressing the holding parts 9' in transverse direction, secure positioning with no play is achieved. Preferably, the deformations occur in the resilient or elastic region.

If grooves are provided in the bar or in parts of the bar for the purpose of positioning, these grooves may be set up for twice the distance of division, which results in robust and mechanically stable solutions, in particular, with finer divisions, whereby said solutions can be implemented with great precision.

It will be appreciated that the above description of the present invention is susceptible to various modifications, changes and modifications, and the same are intended to be comprehended within the meaning and range of equivalents of the appended claims.

LIST OF REFERENCE NUMBERS

1, 1' Bar
2 Tools
B, W Longitudinal directions
3 Tool set
4, 4*a* Tool set of the first type
5, 5*a* Tool set of the second type
6 Working part of the first tool type
7, 7*a* Holding part of the first tool type
8 Working part of the second tool type
9 Holding part of the second tool type
10, 11 Hook
12-15 Narrow sides
16, 16-4, 16-5 Cutouts
17, 17*a*, 17*b* Support surface
18 Clamping strip
19, 20 Feet
21 Longitudinal groove
22 Positioning means
22*a* Strip
23-26 Feet
27, 28 Longitudinal grooves
29, 30 Section
31 Part

What is claimed is:

1. Tool set for loading a bar of a knitting machine, said set comprising:

tools of a first type, said tools having a working part and a holding part, and tools of a second type having a working part and a holding part, and wherein the tools are to be arranged on the bar in an alternating manner and are different from each other regarding the configuration of their holding parts, and the holding parts of the tools of the one type are respectively arranged between two holding parts of the tools of the other type and are positioned by them in their transverse direction.

2. Tool set in accordance with claim 1, wherein the tools of the first type and the tools of the second type have working parts that have the same configuration.

3. Tool set in accordance with claim 1, wherein the working parts of the tools of the first and/or the second types have widths that are smaller than the widths of the holding parts, of the tools of the first and/or second types.

4. Tool set in accordance with claim 1, wherein the holding parts of the tools of the first type and the holding parts of the tools the second type have a different holding part height, at least at a pre-specified axial position (A) of their respective holding member.

5. Tool set in accordance with claim 1, wherein at least the holding part of the tool of one of the two types is associated with a positioning means which interacts with the bar in order to define the position of the tool in its transverse direction (B) relative to the bar, whereby the transverse direction (B) extends in a longitudinal direction relative to the bar.

6. Tool set in accordance with claim 5, wherein the positioning means is a section of the holding part of the tool, said section engaging in a cutout of the bar.

7. Tool set in accordance with claim 5, characterized in that the positioning means (22) is a cutout of the tool accommodating a projection (22*a*) of the bar (1).

8. Tool set in accordance with claim 1, wherein the tools are provided, on their holding parts, with projections for the purpose of positioning in a direction (H), whereby this direction (H) is perpendicular to the longitudinal direction (W) of the tools, as well as to the longitudinal direction (B) of the bar.

9. In combination, a for the accommodation of tools of the tool set in accordance with claim 1, wherein the bar comprises positioning means only for one group of tools.

10. In combination, a for the accommodation of tools of the tool set, in accordance with claim 1 wherein the bar comprises positioning means for tools of both types, whereby the positioning means of the tools of the first type are arranged, in a longitudinal direction (W) of the tools, offset with respect to the positioning means of the tools of the other type.

11. Tool set for loading a bar of a knitting machine, said set comprising:

tools of a first type, said tools having a working part and a holding part, and tools of a second type having a working part and a holding part and wherein the tools are to be arranged on the bar in an alternating manner and are different from each other regarding the configuration of their holding parts, at least the holding part of the tool of one of the two types is associated with a positioning means which interacts with the bar in order to define the position of the tool in its transverse direction (B) relative to the bar, whereby the transverse direction (B) extends in a longitudinal direction relative to the bar, and the positioning means is a cutout of the tool accommodating a projection of the bar.

12. Tool set loaded on a bar of a knitting machine, comprising:

tools of a first type having a working part and a holding part, and tools of a second type having a working part and a holding part, and wherein the tools are arranged on the bar in an alternating manner and are different from each other regarding the configuration of their holding part, the holding parts of the tools of the first type and the holding parts of the tools the second type have a different holding part height, at least at a pre-specified axial position (A) of their respective holding members.

* * * * *